US005422662A

United States Patent [19]

Fukushima et al.

[11] Patent Number: 5,422,662

[45] Date of Patent: Jun. 6, 1995

[54] THERMAL PRINTER HEAD HAVING CURRENT SENSORS CONNECTED TO HEATING ELEMENTS

[75] Inventors: Itaru Fukushima, Tokyo; Nakaba Nakamura, Kyoto; Takashi Okamoto, Fukui, all of Japan

[73] Assignees: NEC Corporation, Tokyo; Susumu Co., Ltd., Kyoto, both of Japan

[21] Appl. No.: 36,831

[22] Filed: Mar. 25, 1993

[30] Foreign Application Priority Data

Mar. 27, 1992 [JP] Japan ..... 4-071014

[51] Int. Cl.[6] ..... B41J 2/35; B41J 2/355

[52] U.S. Cl. ..... 342/211

[58] Field of Search ..... 346/76 PH; 400/120

[56] References Cited

U.S. PATENT DOCUMENTS 4,330,786 5/1982 Hatabe et al. ..... 346/76 PH
4,887,092 12/1989 Pekruh et al. ..... 346/76 PH
5,132,709 7/1992 West ..... 346/76 PH

FOREIGN PATENT DOCUMENTS 0320435 6/1989 European Pat. Off. .
62-116168 5/1987 Japan .

*Primary Examiner*—Huan H. Tran
*Attorney, Agent, or Firm*—Sughrue, Mion, Zinn, Macpeak & Seas

[57] ABSTRACT

A thermal printer head comprises an array of heating elements (1-1~1-N) mounted on an insulating base member (20). Each of the heating elements is connected to a common voltage source (V) and has a temperature dependent electrical resistance. Electrically resistive elements (2-1~2-N) are respectively connected in series with the heating elements to form a plurality of series circuits. Current supply circuits (3-1~3-N, 4-1~4-N, 5, 6, 7-1~7-N, 14) are provided corresponding respectively to the resistive elements for selectively supplying a current to the series circuits in response to a sequence of print signals. A control circuit (8-11, 14) makes a determination whether a voltage developed across each resistive element is higher or lower than a prescribed threshold value and causes one of the current supply ciruits corresponding to the resistive element to control the current depending on the determination.

9 Claims, 4 Drawing Sheets

THERMAL PRINTER HEAD HAVING CURRENT SENSORS CONNECTED TO HEATING ELEMENTS

BACKGROUND OF THE INVENTION

1. Field of the Invention

The present invention relates to a thermal printer head having an array of heating elements wherein the current supply to the heating elements is controlled according to a parameter representative of the temperature of the heating elements.

2. Description of the Related Art

With current thermal printer heads, the printed image density is initially low during a period immediately following the start of a print and becomes high with time as the printing process continues. This is due to the absorption of thermal energy partly by the printer head itself and partly by materials surrounding the head. Since this initial image density variation seriously degrades the quality of a printed material, proposals have been made to overcome this heat absorption problem.

One prior art proposal maintains a record of energy that has been supplied to the printer head for a period of time and uses this record as correction data to control the amount of energy subsequently supplied to the head. While this method proved successful for applications where the print ratio and its variation are both small, such as in the case of character printing, it requires a large amount of past records for printing a graphic image since its print ratio varies significantly in the directions of coordinates. Large scale integration technology is therefore necessary for implementation.

Another prior art method involves the use of a thermistor temperature sensor for producing a signal representative of the temperature of the heating elements and controlling the amount of energy supplied to them according to the detected temperature. Since the temperature sensor is secured to a common base member on which the heating elements are mounted, it is impossible to measure the temperature variations of the individual heating elements. Additionally, there is a time lag between the output of the temperature sensor and the temperature value actually generated by the heating elements. Furthermore, the slow response characteristic of the temperature sensor is detrimental for precision control required in graphic applications.

In addition, recent needs for color printing have accelerated the demand for a printer capable of reproducing subtle gradations, and precision thermal energy control is thus required.

SUMMARY OF THE INVENTION

It is therefore an object of the present invention to provide an improved thermal printer head having a high-speed operating performance.

According to the present invention, there is provided a thermal printer head which comprises an array of heating elements mounted on an insulating base member, each of the heating elements being connected to a common voltage source and having a temperature dependent electrical resistance. A plurality of electrically resistive elements are respectively connected in series with the heating elements to form a plurality of series circuits. A plurality of current supply means are provided corresponding respectively to the resistive elements for selectively supplying a current to the series circuits in response to a sequence of print signals. A control circuit is provided for making a determination whether a voltage developed across each of the resistive elements is higher or lower than a prescribed threshold value and causing the current supply means corresponding to the resistive element to control the current depending on the determination.

According to a specific aspect of the present invention, the control circuit comprises a first scanner for sequentially connecting a check point to the resistive elements, a comparator for comparing a voltage at the check point with the prescribed threshold value and producing an output signal when the check point voltage is higher than the prescribed threshold value, and a second scanner synchronized with the first scanning means for sequentially connecting the output of the comparator means to the plurality of current supply means to cause the output signal to cease the current supplied to the resistive element to which the check point is being connected.

According to a further aspect, the control circuit further comprises a variable threshold setting circuit synchronized with the first scanner for causing the prescribed threshold value to vary uniquely with respect to each of the heating elements to improve gradations.

BRIEF DESCRIPTION OF THE DRAWINGS

The present invention will be described in further detail with reference to the accompanying drawings, in which.

DETAILED DESCRIPTION

Figure 1:
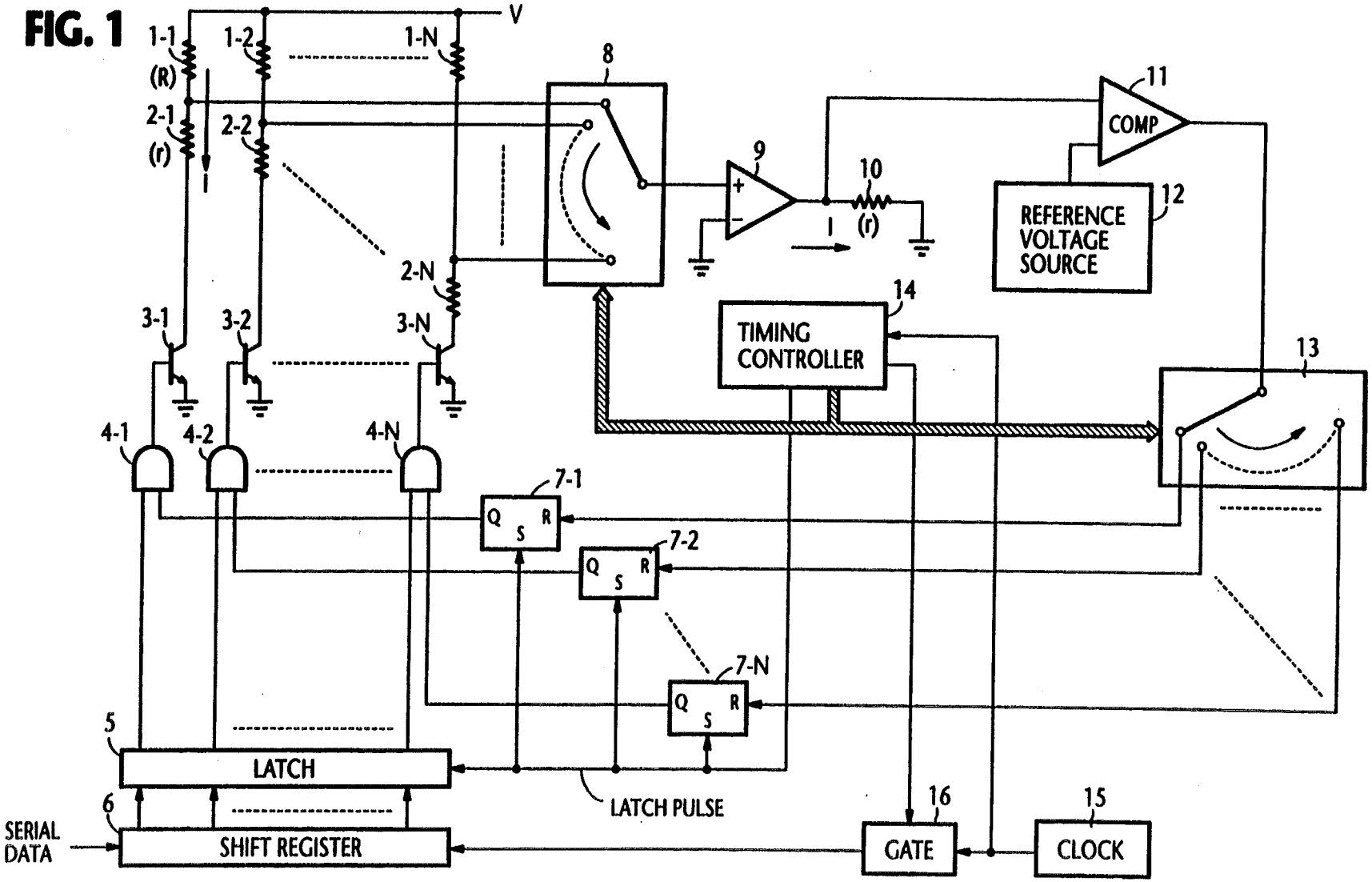
FIG. 1 is a block diagram of a thermal printer head according to a first embodiment of the present invention.
Figure 2:
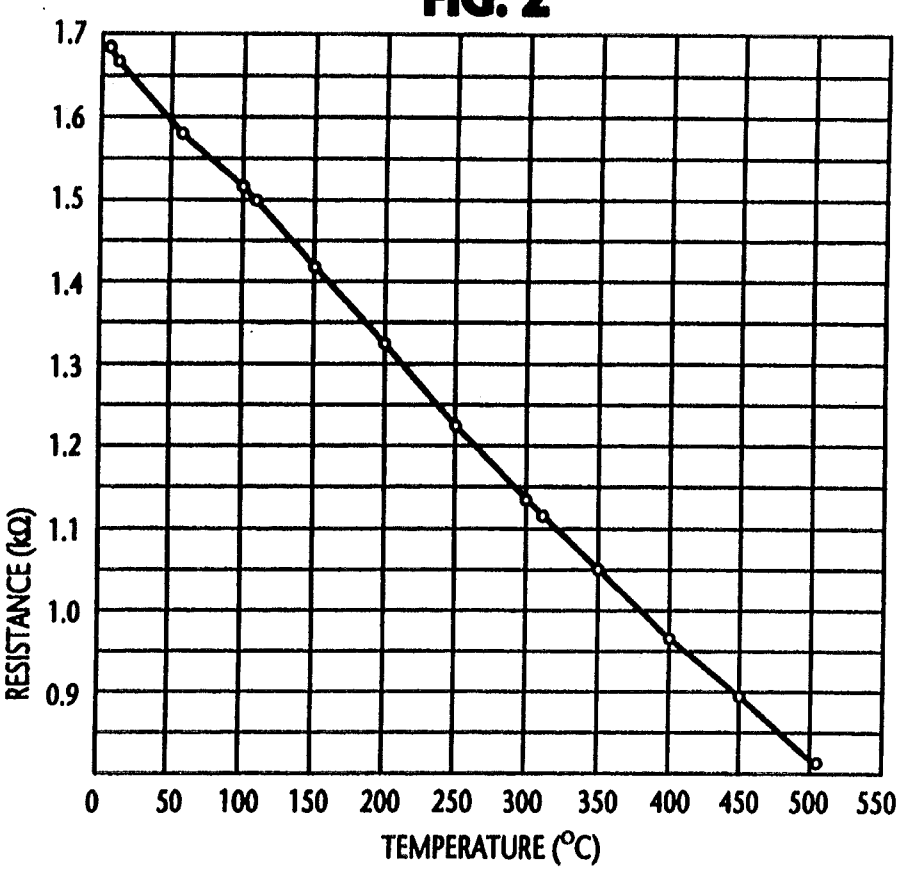
FIG. 2 is a graphic representation of the negative temperature characteristic of a typical heating element.
Figure 3:
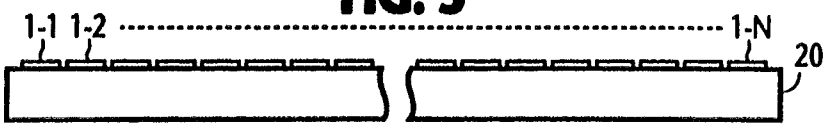
FIG. 3 is a side view of the thermal printer head showing details of the heating elements and a base member on which the heating elements are mounted.

Referring now to FIG. 1, there is shown a thermal printer head according to a first embodiment of the present invention. The thermal printer head of this invention comprises a linear array of heating elements 1-1~1-N, where a typical value of N is $2^{11}$, or 2048. All of the heating elements are composed of materials having a high resistance of negative temperature coefficient as graphically illustrated in FIG. 2. In a typical example, the heating elements are composed of chromium with a 25 atomic percent of aluminum similar to the composition of conventional thermistors. The heating elements 1 are formed into rectangular-or square-shaped thin films and secured and arranged on the surface of a glass plate 20 as shown in FIG. 3 to form a linear array of print elements. At room temperature, each heating element has a resistance of 1.67 KΩ and the resistance decreases almost linearly with a rise in temperature caused by a current flow.

One end of each heating element is connected to a voltage source V and the other end is connected to a respective one of current sensing resistors 2-1~2-N of an identical resistance value "r" which is much smaller than the resistance "R" of the heating elements when they are heated to a maximum operating temperature of the thermal printer head. Switching transistors 3-1~3-N are provided in a one-to-one association with the current sensing resistors 2-1~2-N and in a one-to-one association with AND gates 4-1~4-N. Each of these transistors has its collector-emitter path connected in series with the associated current sensing resistor and its base connected to the output of the associated AND gate to draw a current from the voltage source V through the associated heating element and current sensing resistor to ground in response to a turn-on signal supplied from the associated AND gate.

Each of the AND gates 4-1~4-N has a first input terminal for receiving a print signal from a corresponding stage of a 2048-stage latch circuit 5 which responds to a latch pulse from a timing controller 14 for receiving print signals in parallel form from a shift register 6, where a serial data input is entered and shifted by shift pulses supplied from a clock source 15 via a gate 16. AND gates 4-1~4-N are respectively associated with flip-flops 7-1~7-N, and each AND gate has a second input terminal for receiving an enable pulse from the output of the associated flip-flop. Each flip-flop 7 has a set input connected to timing controller 14 to respond to the latch pulse for enabling the associated AND gate 4 and has a reset input connected to one of the terminals of a high-speed electronic switch, or second scanner 13.

The junction between each heating element 1 and the associated current sensing resistor 2 is connected to a respective one of terminals of a high-speed electronic switch, or scanner 8 having an electronically controlled moving contact connected to the noninverting input of a unity gain operational amplifier 9, whose inverting input is connected to ground. The output of amplifier 9 is connected by a resistor 10 of identical value to the resistance "r" of each current sensing resistor 2. A potential developed at the junction between the output of amplifier 9 and resistor 10 is applied to the first input of an analog comparator 11. A reference voltage source 12 is provided for supplying a constant reference voltage to the second input of the comparator 11. Comparator 11 produces a reset signal when the output of amplifier 9 is equal to or higher than the reference voltage. This reset signal is applied to the electronically controlled moving contact of switch 13.

Timing controller 14 receives clock pulses from the clock source 15 and generates a switching control signal identifying each successive terminal of the electronic switches 8 and 13. In response to the switching control signal, each of the electronic switches 8 and 13 successively advances its moving contact in order to allow the comparator 11 to compare the voltage across each current sensing resistor 2 with the reference voltage to determine the reset timing of a corresponding one of flip-flops 7.

Since the resistance "r" of each current sensing resistor 2 is much smaller than the lowest operating resistance R of the associated heating element 1, the current I flowing through each sensing resistor 2 is approximately equal to $I=V/R$. Additionally, because of the equality of the resistor 10 to the resistance "r" of the sensing resistor 2, the output voltage E of the unity gain amplifier 9 is given by $E=r\times I=r\times V/R$ and hence inversely proportional to the resistance of the heating element.

If the maximum operating temperature of the heating element 1 is set equal to 350° C. (FIG. 2), the resistance "R" is equal to 1.05 KΩ. If the source voltage V is 24 volts, the current $I_R$ through the heating element is approximately 23 mA. A reference voltage $V_R$ ($=I_R\times r$)is supplied from the reference voltage source 12 to the comparator 11 as a representative of the maximum operating temperature of each heating element for comparison with the voltage output of amplifier 9 that represents the current temperature of the heating element.

Figure 4:
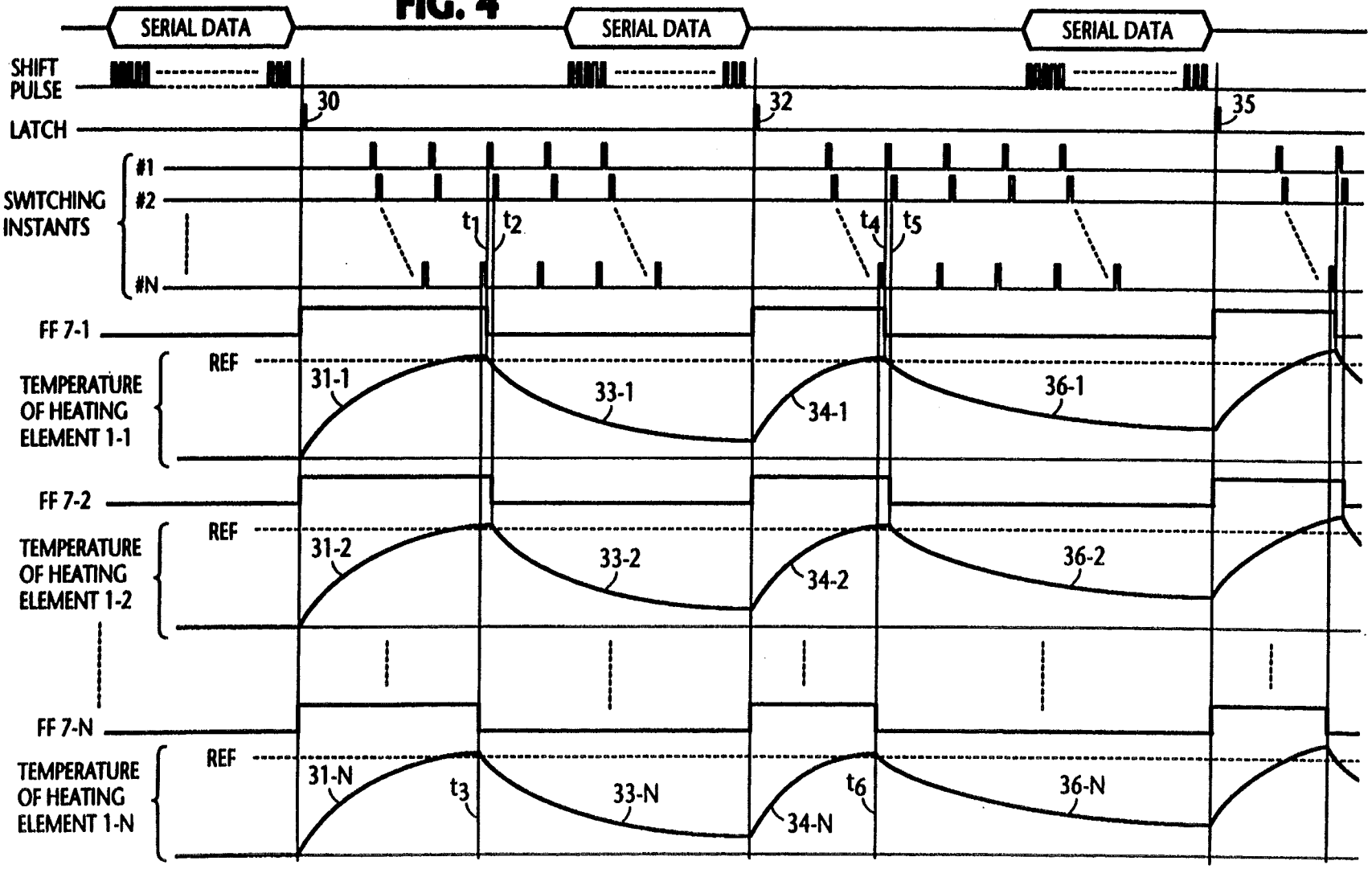
FIG. 4 is a timing diagram for a better understanding of the first embodiment of the present invention.

The operation of the first embodiment of this invention will be best understood with a description given below with reference to FIG. 4. A series of high-and low-level print signals is shifted into shift register 6 in response to a sequence of clock pulses from gate 16 and then fed in parallel to latch 5 where they are latched in response to a latch pulse from controller 14. All flip-flops 7 are set in response to the latch pulse, applying high-level signals to the associated AND gates 4 as enable pulses. The high-level print signals are passed through the enabled AND gates to the corresponding switching transistors 3. Thus, only those transistors applied with high-level print signals are turned on, causing currents I to flow through desired heating elements 1. Heat builds up in the heating elements and their resistance decreases with time, resulting in the generation of an exponential voltage rise in those of the current sensing resistors that are connected to the heated elements.

The potential across each current sensing resistor is scanned and coupled through switch 8 and buffer amplifier 9 to comparator 11 where it is compared with the reference threshold voltage that represents the maximum operating temperature of the heating element. If heating elements 1-1, 1-2 and 1-N are activated in response to a latch pulse 30, exponentially rising voltages develop across the associated current sensing resistors 2-1, 2-2 and 2-N corresponding to temperature rises indicated at 31-1, 31-2 and 31-N. If these voltages are higher than the threshold level REF at the respective switching instants $t_1$, $t_2$ and $t_3$, the corresponding flip-flops 7-1, 7-2 and 7-N are reset to turn off switching transistors 3-1, 3-2 and 3-N, thus stopping the current supply to the heating elements 1-1, 1-2 and 1-N to allow the temperatures of the heating elements 1-1, 1-2 and 1-N to decrease exponentially as indicated in FIG. 4. Since the heating elements are mounted on a glass base member 20, a certain amount of the heat generated by the heating elements is therefore conducted to the base member 20 and stored therein. Therefore, at the instant the heating elements 1-1, 1-2 and 1-N are again activated by the next latch pulse 32, the temperature values of heating elements 1-1, 1-2 and 1-N have not decreased to the initial temperature level as indicated by curves 33-1, 33-2 and 33-N, and exponentially rising voltages develop across current sensing resistors 2-1, 2-2 and 2-N corresponding respectively to temperature curves 34-1, 34-2 and 34-N which start to rise from the level of the thermal energy stored in the base member. As a result, the voltages across sensing resistors 2-1, 2-2 and 2-N reach the threshold level within a shorter period than the previous cycle. Thus, at switching instants $t_4$, $t_5$ and $t_6$, the threshold level is exceeded by the respective voltages, and flip-flops 7-1, 7-2 and 7-N are reset, allowing the heating elements 1-1, 1-2 and 1-N to decrease their temperatures. In this way, when these flip-flops are again set in response to a third latch pulse 35, the temperatures of heating elements 1-1, 1-2 and 1-N have decreased, following curves as indicated at 36-1, 36-2 and 36-N, to a level which may be higher than the previous storage level due to the additional storage of thermal energy. The heating elements are supplied with a lesser amount of energy as the temperature of the base member increases. This condition continues until a balance is established between the amount of energy supplied to the heating element and the amount of thermal energy stored in the base member. Thereafter the heating elements are maintained at a constant temperature.

Since the heating elements are controlled by their temperature-representative voltages, print density control can be made precisely at high speeds, allowing the thermal printer head to be operated at high speeds.

Figure 5:
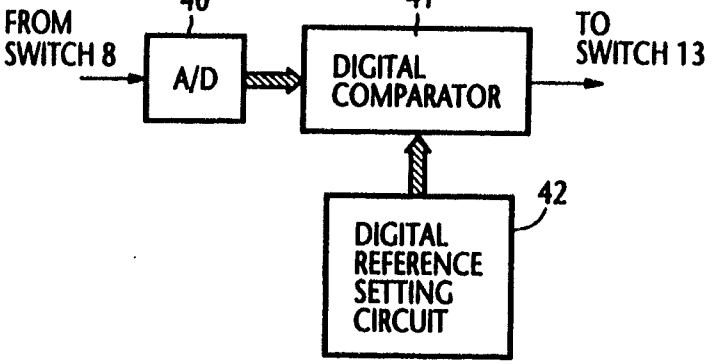
FIG. 5 is an illustration of a modification of the first embodiment.

To take advantage of the recent digital technologies, digital circuit components are used for the thermal printer head. From the manufacturing viewpoint, it is preferable to modify the embodiment of FIG. 1 as shown in FIG. 5. As illustrated, the buffer amplifier 9 and resistor 10 of the previous embodiment are replaced with an analog-to-digital converter 40, and the comparator 11 and reference voltage source 12 are replaced with a digital comparator 41 and a digital reference setting circuit 42. A/D converter 40 is of a conventional design which includes a set of comparators for comparing the input voltage from the switch 8 with multiple threshold voltages to produce a set of binary digits, which are then compared bit-by-bit by comparator 41 with a set of reference binary digits established by the setting circuit 42. Comparator 41 generates a reset signal for flip-flops 7 when the output of A/D converter 40 is equal to or higher than the reference setting.

While mention has been made of an embodiment in which the heating elements are described as having a negative resistance, heating elements of positive resistance characteristic could equally be as well employed for character printing purposes. However, it is desirable to use heating elements of negative resistance for applications where subtle gradations are required for the reproduction of halftone or color images since thermal energy concentration occurs on the surface of such heating elements.

Figure 7:
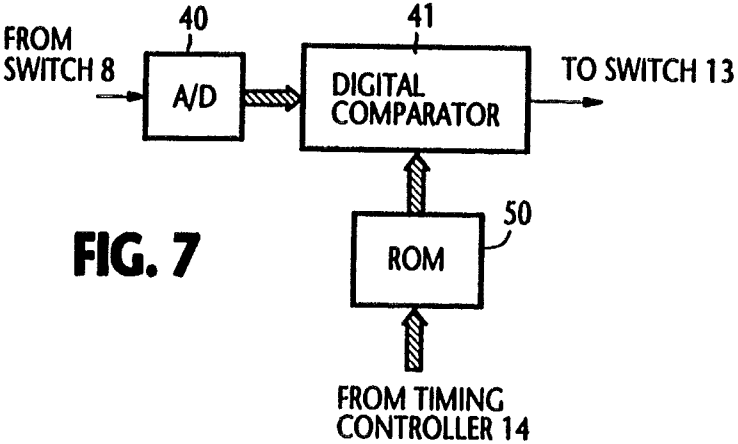
FIG. 7 is an illustration of a modification of the second embodiment.
Figure 6:
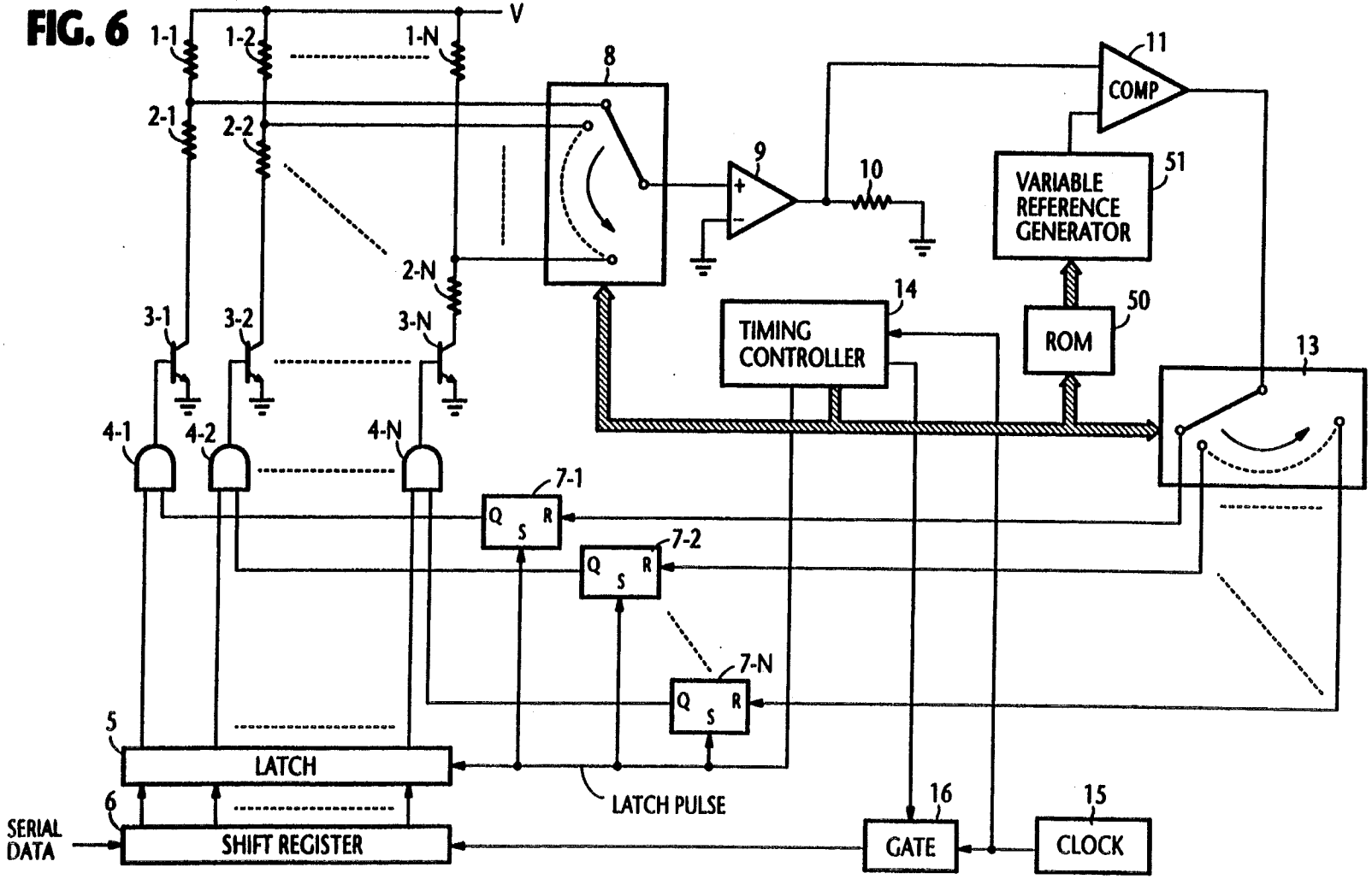
FIG. 6 is a block diagram of a thermal printer head according to a second embodiment of the present invention.

The embodiment shown in FIG. 6 is suited for color image reproduction. This embodiment differs from the first embodiment in that it includes a read only memory 50 and a variable reference generator 51. The ROM 50 receives the digital timing signal from the timing controller 14 and defines a map between each received signal identifying the respective terminal of switch 8 (i.e., the individual heating elements) on the one hand and a unique gradation level (i.e., one of 256 gradations) on the other. In this way, each heating element has a particular threshold level rather than a constant value of threshold which is uniformly employed for all heating elements in the previous embodiment. The ROM 50 produces a digital output representing a unique gradation level for each heating element. In response to the output of ROM 50, variable reference generator 51 generates and supplies a voltage as a unique gradation threshold to comparator 11. As a result, each heating element is constantly maintained at a level corresponding to the uniquely determined threshold. A preferred form of this embodiment is shown in FIG. 7 where the A/D converter 40 and digital comparator 41 are used as in the case of the modification of FIG. 5 for making a direct comparison between the output of A/D converter 40 and the output of the ROM 50 as it represents the unique gradation level in digital form.

What is claimed is:

1. A thermal printer head comprising:

an array of heating elements mounted on an insulating base member, each of the heating elements being connected to a common voltage source and having a temperature dependent electrical resistance;

a plurality of electrically resistive elements connected in series with said heating elements, respectively, to form a plurality of series circuits;

a plurality of current supply means corresponding respectively to said resistive elements for selectively supplying a current to said series circuits in response to a sequence of print signals; and control means for making a determination whether a voltage developed across one of said resistive elements is higher or lower than a prescribed threshold value and causing one of said current supply means corresponding to said one of said resistive elements to control said current depending on the determination, wherein said control means comprises:

first scanning means for sequentially connecting a check point to said resistive elements;

comparator means for comparing a voltage at said check point with said prescribed threshold value and producing an output signal when the check point voltage is higher than said prescribed threshold value; and second scanning means synchronized with said first scanning means for sequentially connecting the output signal of said comparator means to said plurality of current supply means to cause said output signal to cease the current supplied to one of said resistive elements to which said check point is being connected.

2. A thermal printer head as claimed in claim 1, wherein each of said heating elements has a negative resistance characteristic.

3. A thermal printer head as claim in claim 1, wherein said control means comprises:

first scanning means for sequentially connecting a check point to said resistive element;

an analog-to-digital converter for converting a voltage at said check point of the first scanning means into a digital signal;

a digital setting means for establishing a digital version of said prescribed threshold value;

a digital comparator for producing an output signal when the digital signal from said analog-to-digital converter is higher than the digital version of said prescribed threshold value; and second scanning means synchronized with said first scanning means for sequentially connecting the output signal of said digital comparator to said plurality of current supply means to cause said output signal to cease the current supplied to one of said resistive elements to which said check point is being connected.

4. A thermal printer head as claimed in claim 1, wherein said control means comprises:

first scanning means for sequentially connecting a check point to said resistive elements;

variable threshold setting means synchronized with said first scanning means for causing said prescribed threshold value to vary uniquely with respect to each of said heating elements;

comparator means for comparing a voltage at said check point with said prescribed threshold value and producing an output signal when the check point voltage is higher than said prescribed threshold value; and second scanning means synchronized with said first scanning means for sequentially connecting the output signal of said comparator means to said plurality of current supply means to cause said output signal to cease the current supplied to one of said resistive elements to which said check point is being connected.

5. A thermal printer head as claimed in claim 1, wherein said control means comprises:

means for successively generating a signal identifying each of said heating elements;

first scanning means responsive to said identifying signal for sequentially connecting a check point to said resistive elements;

an analog-to-digital converter for converting a voltage at said check point into a digital signal;

conversion table means for converting the identifying signal into a digital prescribed threshold value;

a digital comparator for producing an output signal when the digital signal from said analog-to-digital converter is higher than the digital prescribed threshold value from said conversion table means; and second scanning means responsive to said identifying signal for sequentially connecting the output signal of said digital comparator to said plurality of current supply means to cause said output signal to cease the current supplied to one of said resistive elements to which said check point is being connected.

6. A thermal printer head comprising:

an array of heating elements mounted on an insulating base member, each of the heating elements being connected to a common voltage source and having a temperature dependent electrical resistance;

a plurality of electrically resistive elements connected in series with said heating elements, respectively, to form a plurality of series circuits;

a plurality of current supply means corresponding respectively to said resistive elements for selectively supplying a current to said series circuits in response to a sequence of print signals; and control means for making a determination whether a voltage developed across one of said resistive elements is higher or lower than a prescribed threshold value and causing one of said current supply means corresponding to said one of said resistive elements to control said current depending on the determination, and for causing said prescribed threshold value to assume a value unique to each of said heating elements.

7. A thermal printer head as claimed in claim 6, wherein each of said heating elements has a negative resistance characteristic.

8. A thermal printer head as claimed in claim 6, wherein said control means comprises:

first scanning means for sequentially connecting a check point to said resistive elements;

variable threshold setting means synchronized with said first scanning means for causing said prescribed threshold value to vary uniquely with respect to each of said heating elements;

comparator means for comparing a voltage at said check point with said prescribed threshold value and producing an output signal when the check point voltage is higher than said prescribed threshold value; and second scanning means synchronized with said fist scanning means for sequentially connecting the output signal of said comparator means to said plurality of current supply means to cause said output signal to cease the current supplied to one of said resistive elements to which said check point is being connected.

9. A thermal printer head as claimed in claim 6, wherein said control means comprises:

means for successively generating a signal identifying each of said heating elements;

first scanning means responsive to said identifying signal for sequentially connecting a check point to said resistive element;

an analog-to-digital converter for converting a voltage at said check point into a digital signal;

conversion table means for converting the identifying signal into a digital prescribed threshold value;

a digital comparator for producing an output signal when the digital signal from said analog-to-digital converter is higher than the digital prescribed threshold value from said conversion table means; and second scanning means responsive to said identifying signal for sequentially connecting the output signal of said digital comparator to said plurality of current supply means to cause said output signal to cease the current supplied to one of said resistive elements to which said check point is being connected.

* * * * *

UNITED STATES PATENT AND TRADEMARK OFFICE

CERTIFICATE OF CORRECTION

PATENT NO. : 5,422,662

DATED : Jun. 6, 1995

INVENTOR(S) : Itaru Fukushima, et al.

It is certified that error appears in the above-indentified patent and that said Letters Patent is hereby corrected as shown below:

Col. 8, line 22, delete "fist" and insert —first—

Signed and Sealed this

Seventh Day of November, 1995

*Attest:*

Bruce Lehman

BRUCE LEHMAN

*Attesting Officer*

*Commissioner of Patents and Trademarks*